US012366061B2

(12) United States Patent
Park

(10) Patent No.: US 12,366,061 B2
(45) Date of Patent: Jul. 22, 2025

(54) WATERJET PLUNGER

(71) Applicant: Moonchang Park, Guri-si (KR)

(72) Inventor: Moonchang Park, Guri-si (KR)

( * ) Notice: Subject to any disclaimer, the term of this patent is extended or adjusted under 35 U.S.C. 154(b) by 0 days.

(21) Appl. No.: 18/255,018

(22) PCT Filed: Jun. 7, 2022

(86) PCT No.: PCT/KR2022/008018
§ 371 (c)(1),
(2) Date: May 30, 2023

(87) PCT Pub. No.: WO2023/113119
PCT Pub. Date: Jun. 22, 2023

(65) Prior Publication Data

US 2024/0392549 A1 Nov. 28, 2024

(30) Foreign Application Priority Data

Dec. 17, 2021 (KR) ..... 10-2021-0181716
Jun. 2, 2022 (KR) ..... 10-2022-0067662

(51) Int. Cl.
*E03C 1/304* (2006.01)

(52) U.S. Cl.
CPC ..... *E03C 1/304* (2013.01)

(58) Field of Classification Search
CPC ..... E03C 1/304
USPC ..... 4/255.01
See application file for complete search history.

(56) References Cited

U.S. PATENT DOCUMENTS 6,295,659 B1 * 10/2001 Sandness ..... E03C 1/306 4/255.09
6,499,151 B1 * 12/2002 Ollinger ..... E03D 9/00 4/255.02
10,060,110 B2 * 8/2018 Bugni ..... E03D 9/00
2017/0022694 A1 1/2017 Broten

FOREIGN PATENT DOCUMENTS

KR 10-2007-0009055 A 1/2007
KR 10-1231342 B1 2/2013
KR 10-1522246 B1 5/2015
KR 10-2018-0013946 A 2/2018
KR 10-2020-0137684 A 12/2020

OTHER PUBLICATIONS

International Search Report dated Sep. 21, 2022 in International Application No. PCT/KR2022/008018.

* cited by examiner

*Primary Examiner* — Lauren A Crane
(74) *Attorney, Agent, or Firm* — Saliwanchik, Lloyd & Eisenschenk

(57) ABSTRACT

Proposed is a water jet plunger. The water jet plunger is provided with a body part having a tubular shape and including a discharge port that can be opened and closed at one end thereof and a pressurizing part disposed inside the body part and capable of reciprocating in the longitudinal direction of the body part, so that as the pressurizing part presses the inside of the body part where water is accommodated, the discharge port provided at one end of the body part is opened by pressure generated by the pressurization of the pressurizing part to spray the water with an instantaneous to remove foreign matter blocking a pipe of a toilet.

8 Claims, 17 Drawing Sheets

WATERJET PLUNGER

CROSS-REFERENCE TO RELATED APPLICATIONS

This application is the U.S. national stage application of International Patent Application No. PCT/KR2022/008018, filed Jun. 7, 2022, which claims the benefit under 35 U.S.C. § 119 of Korean Application Nos. 10-2021-0181716, filed Dec. 17, 2021; and 10-2022-0067662, filed Jun. 2, 2022; the disclosures of each of which are incorporated herein by reference in their entirety.

TECHNICAL FIELD

The present disclosure relates to a waterjet plunger and, more particularly, to a waterjet plunger that sprays water with instant pressure to remove foreign matter in a toilet.

BACKGROUND ART

Due to urbanization, people's living environment has changed rapidly in recent years, and the residential environment has changed dramatically compared to the past. In particular, a toilet room where hygiene should be the most emphasized in real life has transformed from a dirty and stinky traditional latrine into a place with a high level of cleanliness equipped with sanitary wares including a hygienic and clean toilet.

In general, toilets allow users to urinate or defecate in a sitting position. In a toilet, a certain amount of water is stored in the cistern, a small tank, and after a user urinates or defecates, the water in the tank is flushed, so that the urine or feces can be discharged into a septic tank. A toilet utilizes an "S" shaped siphon structure to inhibit the water from flowing up from a sewage pipe. However, due to the "S" shaped structure, toilet paper or foreign matter block the pipe, resulting in a clogged toilet.

As an example of an effort to address these issues, Korean Patent Application Publication No. 10-2007-0009055 (hereinafter referred to as "cited invention") discloses a configuration for solving the clogging of a drain or toilet by making a close-fitting member come into close contact with an inlet of the drain to accommodate the inlet of the drain, so that the pressure inside a casing is discharged by means of a piston to a discharge pipe to remove foreign matter clogging the drain.

Still, the cited invention has a problem that, as the pressure inside the casing is constantly discharged through the discharge pipe by means of the piston, when the area of blockage is wide or the size of the foreign matter blocking the pipe is large, unclogging may not be easily performed. In order to solve this problem, a means to discharge a large force at once and unclog the toilet is needed.

DISCLOSURE

Technical Problem

Accordingly, the present disclosure has been made keeping in mind the above problems occurring in the related art, and the present disclosure is intended to propose a waterjet plunger provided with a body part having a tubular shape and including a discharge port that can be opened and closed at one end thereof and a pressurizing part disposed inside the body part and capable of reciprocating in the longitudinal direction of the body part, so that as the pressurizing part presses the inside of the body part where water is accommodated, the discharge port provided at one end of the body part is opened by pressure to solve the clogging of a toilet by spraying the water with an instantaneous pressure rather than releasing the pressure constantly.

Technical Solution

In order to achieve the above objectives, according to an embodiment of the present disclosure, there is provided a waterjet plunger, including: a body part configured to have a tubular shape; and a pressurizing part disposed inside the body part, and configured to have a piston capable of reciprocating in a longitudinal direction of the body part at a first end thereof, wherein the body part may include a discharge port configured to control water injected from an outside on a first end side thereof, wherein the discharge port may be opened by pressure generated as water accommodated in the body part is pressed by the pressurizing part to discharge the water toward a first end of the body part.

In addition, the body part may further include: a siphon insertion port provided at the first end thereof at an obtuse angle with the body part, and configured to have a size corresponding to an inlet of a siphon tube of a toilet so as to be insertable into the siphon tube of the toilet.

In addition, the discharge port may be coupled with an opening/closing port provided on a first end side of an inner side of the body part by magnetic force to inhibit water from being discharged to the outside, and the discharge port may be opened as the opening/closing port is pressed toward the discharge port by the pressure generated from the pressurizing part.

In addition, the discharge port may be provided with a discharge hole therein and formed in a plate shape with an edge corresponding to the inner side of the body part, wherein the discharge hole may be provided with a ring-shaped flange having magnetic properties on an inner periphery thereof so as to be coupled with the opening/closing port by a magnetic force, and a connecting port coupled to a hinge, provided on a surface of the discharge port in a direction in which water is discharged, may be connected to a surface of the opening/closing port so that the discharge hole and the opening/closing port are coupled by the magnetic force at a certain position.

In addition, the discharge port may be opened and closed as the opening/closing port and a point inside the body part are coupled by means of an elastic member.

In addition, the body part may further include: a water injection inlet formed to be inclined upward at a second end thereof for injecting water into the body part from the outside.

In addition, the pressurizing part may have a hollow shape, and the piston may include: a longitudinal hole at a position corresponding to an inner space of the pressurizing part, and piston valves provided on a surface in a direction of the discharge port, and configured to be opened and closed so that water introduced into the pressurizing part from the outside moves in the direction of the discharge port.

In addition, the pressurizing part may be provided with a water inflow inlet in an upper direction adjacent to the piston, wherein the water inflow inlet may allow water introduced into the body part and accommodated above the piston to flow into the inner space of the pressurizing part.

In addition, the pressurizing part may further include: a water injection inlet provided at a second end thereof to allow water to flow into an inside of the pressurizing part.

Advantageous Effects

According to the present disclosure, it is possible to remove foreign matter blocking a pipe of a toilet since an opening/closing port is provided at one end of a body part and, in a state in which water flowing into the body part from the outside is accommodated, a pressurizing part disposed inside the body part presses the body part where the water is accommodated, so that the opening/closing port provided at one end of the body part is opened and the water is sprayed with an instantaneous pressure.

BEST MODE

Figure 1:
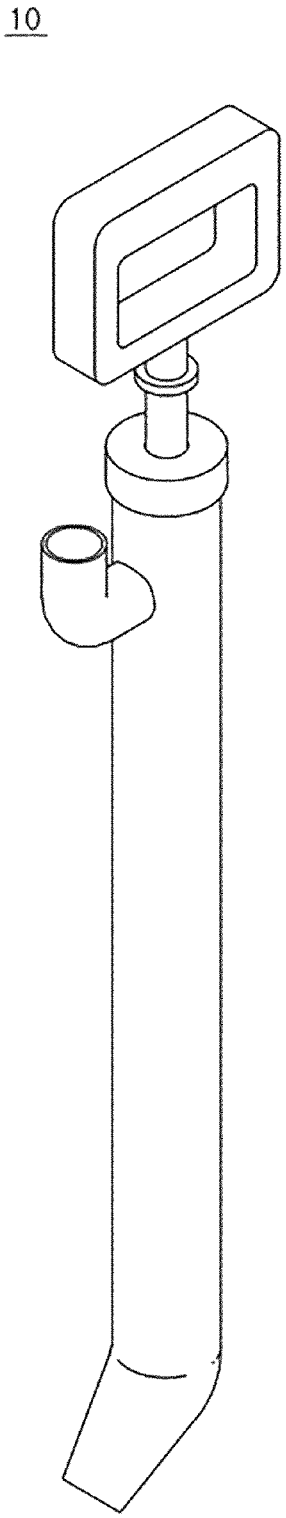
FIG. 1 is a perspective view of a water jet plunger according to an embodiment of the present disclosure.

An objective of the present disclosure is to provide a water jet plunger configured to have: a body part having a tubular shape and including a discharge port that can be opened and closed at one end thereof, and a pressurizing part disposed inside the body part and capable of reciprocating in the longitudinal direction of the body part, so that as the pressurizing part presses the inside of the body part where water is accommodated, the discharge port provided at one end of the body part is opened by pressure generated by the pressurization of the pressurizing part to spray the water with an instantaneous to remove foreign matter blocking a pipe of a toilet.

The scope of the present disclosure is not limited to the embodiments described below, and various modifications may be made by those skilled in the art within the scope of not departing from the technical gist of the present disclosure.

As shown in FIGS. 1 to 17, a waterjet plunger 10 of the present disclosure may include: a body part 100 in the shape of a hollow tube; and a pressurizing part 200 having one end thereof provided inside the body part 100 and reciprocating in the longitudinal direction of the body part 100.

As shown in FIGS. 2 to 6, the body part 100 may be provided with a discharge port 120 for controlling water injected from the outside at one end side thereof. In a state in which the water injected from the outside is accommodated in the body part 100, the opening/closing port 130 is opened by the pressure generated as the pressurizing part 200 is moved toward a discharge port 120, and through the discharge port 120, the accommodated water may be discharged with an instantaneous pressure in the direction of one end of the body part 100.

Figure 2:
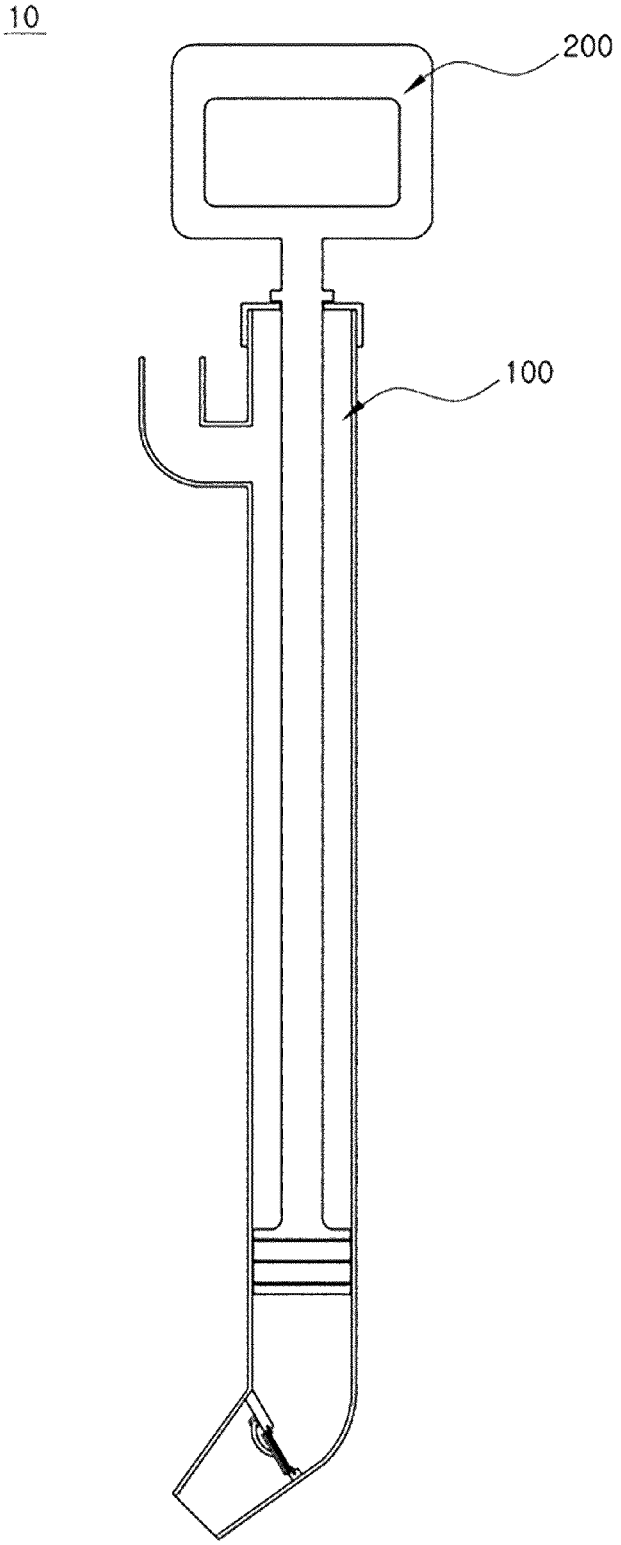
FIG. 2 is a cross-sectional view of the water jet plunger according to the embodiment of the present disclosure.
Figure 3:
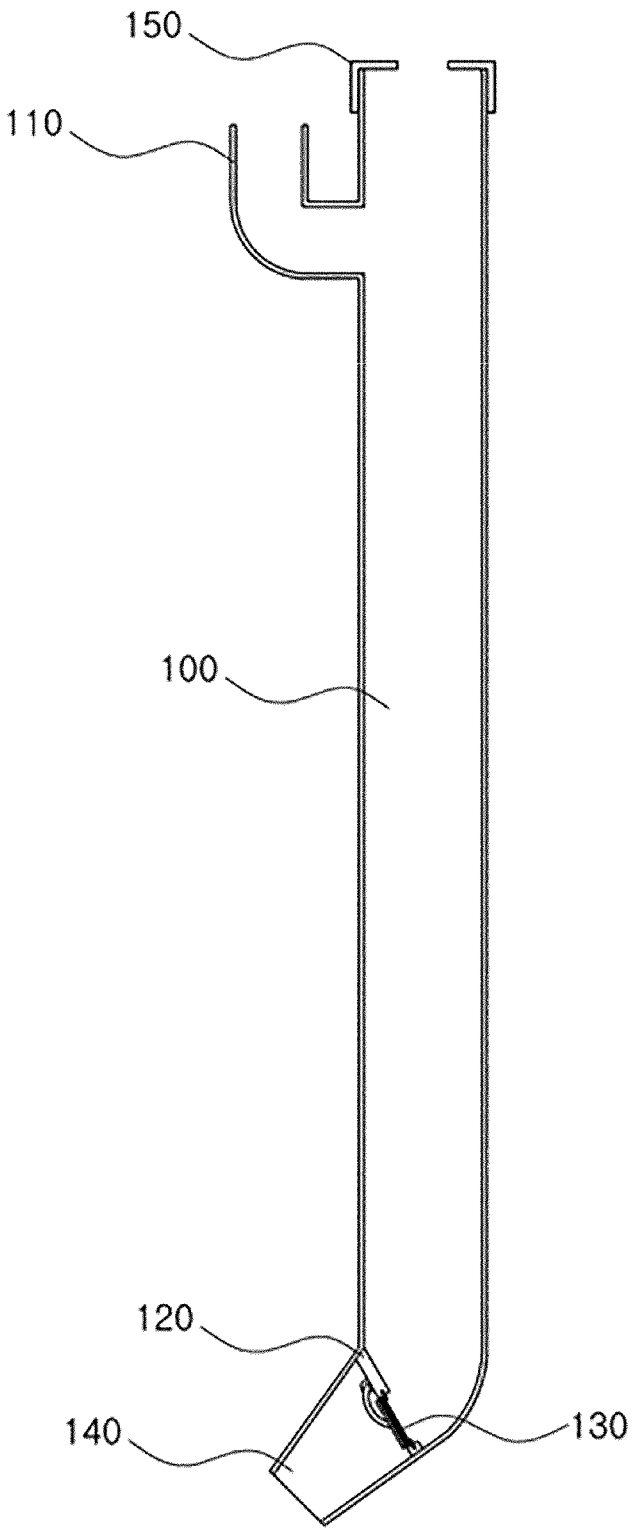
FIG. 3 is an exemplary view of a body part according to the embodiment of the present disclosure.
Figure 4:
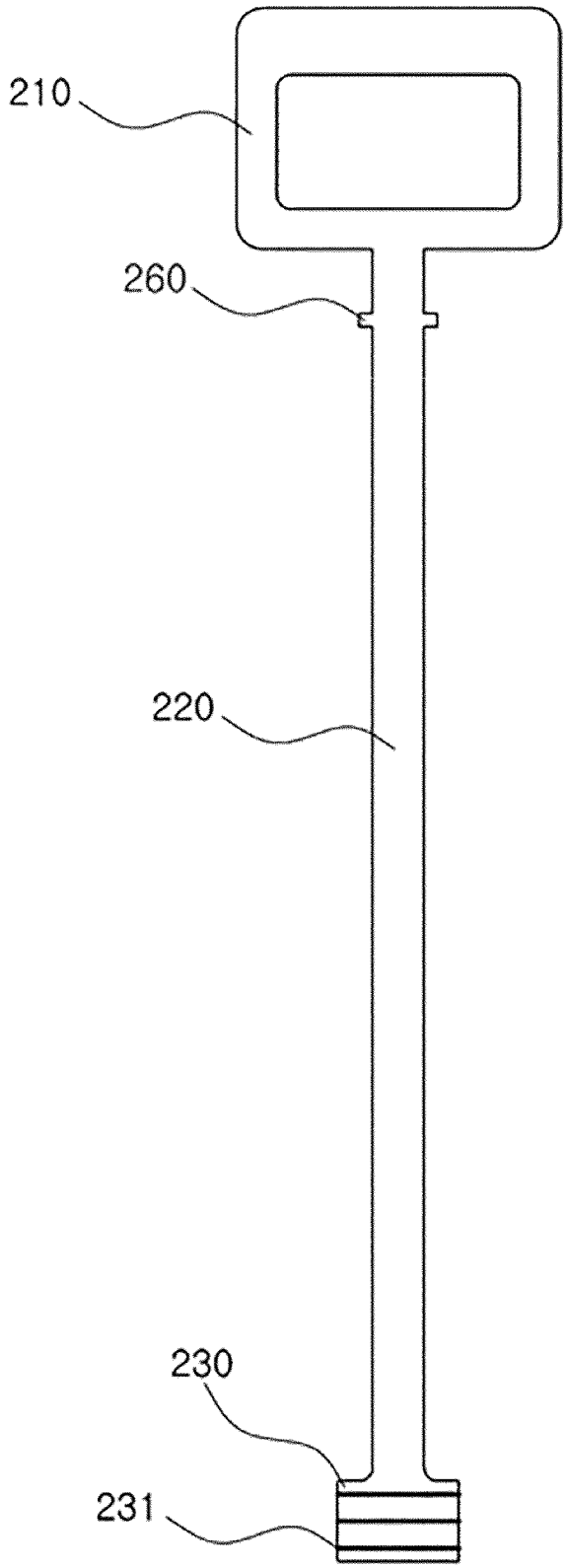
FIG. 4 is an exemplary view of a pressurizing part according to the embodiment of the present disclosure.

As shown in FIGS. 2 to 3, the body part 100 may be formed in the shape of a hollow tube. At this time, the body part 100 may be formed so that the shape of the inside of the body part 100 and the shape of a piston 230 correspond in order for the piston 230 provided in the pressurizing part 200 is inserted into the body part 100 and moved in the longitudinal direction of the body part 100.

At this time, the water accommodated in the body part 100 may be discharged to the outside by pressure generated as the pressurizing part 200 moves from the upper side of the body part 100 to the lower side the body part 100 in the body part 100. It is preferable that the inner shape of the body part 100 is cylindrical in order to smoothly discharge the accommodated water to the outside with instantaneous pressure.

In addition, as shown in FIGS. 1 to 3, the body part 100 may have a water injection inlet 110 to receive water from the outside into the inner space thereof, and the water injection inlet 110 may be formed at the other end of the body part 100 so as to be inclined upward while communicating with the body part 100.

As for the water injection inlet 110, the shape for injecting water into the body part 100 from the outside and the method of injecting water into the body part 100 from the outside are not limited. However, the water injection inlet 110 is preferably formed to be inclined upward while communicating with the body part 100, or to have a longitudinal cross section formed in a "." shape in order to facilitate the role of the water injection inlet 110 to inject water into the body part 100 from the outside.

Figure 6:
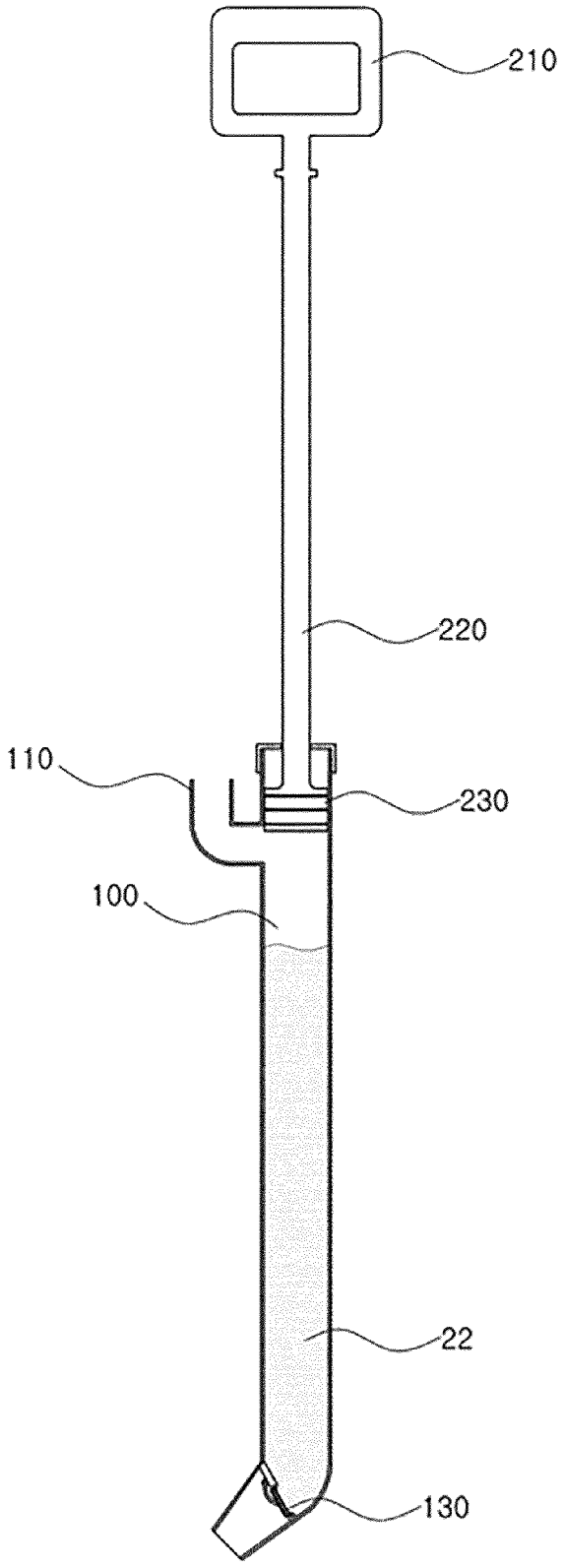
FIG. 6 is an exemplary view of the water jet plunger according to the embodiment of the present disclosure.

In addition, as shown in FIG. 6, the water injection inlet 110 may communicate with the body part 100 at a position lower than the height when the piston 230 of the pressurizing part 200 disposed in the body part 100 is raised to the maximum in the body part 100. Due to this, when water is accommodated in the body part 100, the pressure delivered from the pressurizing part 200 may be smoothly transferred to the accommodated water by means of the piston 230.

The water accommodated inside the body part 100 does not flow into the body part 100 only through the water injection inlet 110, and the method of introducing water from the outside into the body part 100 may not be limited.

At this time, when the water injection inlet 110 is not provided in the body part 100, water may be introduced into the body part 100 through the other end of the pressurizing part 200 having an empty interior, details of which will be described in detail through another example to be described later.

As shown in FIGS. 1 to 15, the body part 100 may have a siphon insertion port 140 at one end thereof that forms an obtuse angle with the body part 100. The siphon insertion port 140 is formed in a size corresponding to the inlet of a siphon tube 21 of a toilet 20 so as to be insertable into the inlet of the siphon tube 21 of the toilet 20.

Figure 16:
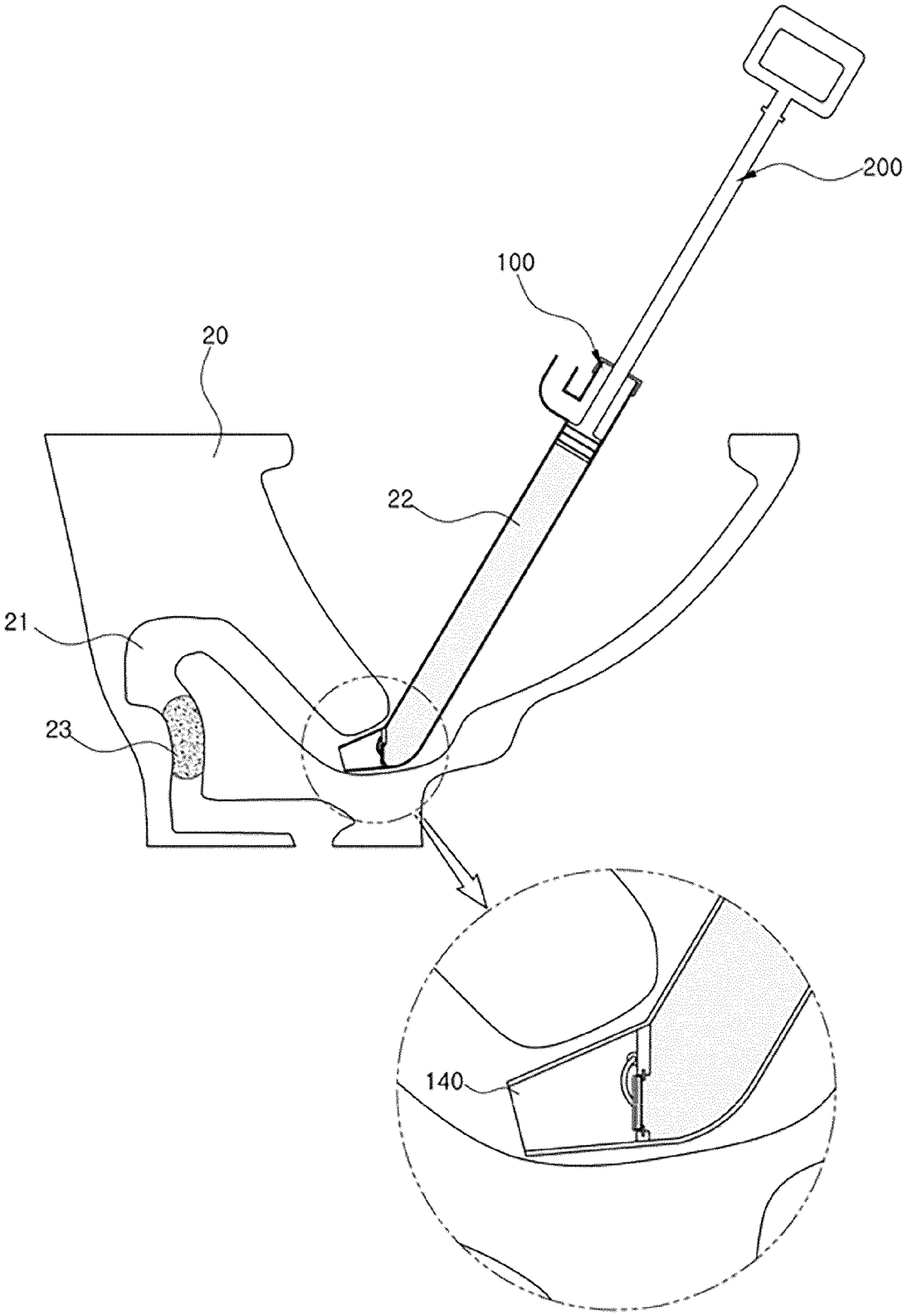
FIGS. 16 to 17 are exemplary views showing the operation of the water jet plunger according to the embodiment of the present disclosure.
Figure 17:
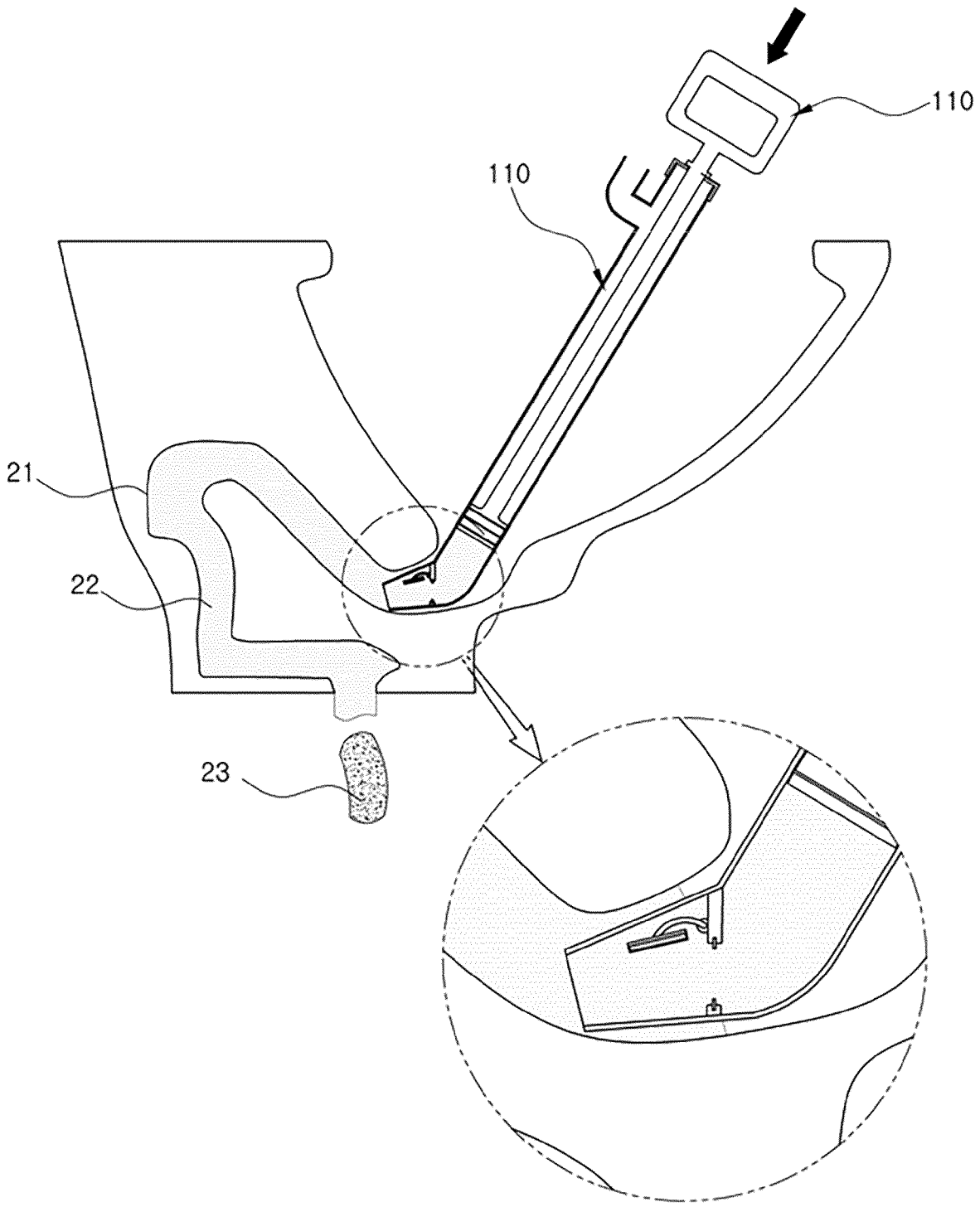

At this time, as shown in FIGS. 2 to 3 and in FIGS. 16 to 17, since the siphon insertion port 140 is formed at an obtuse angle and is formed to be inserted into the inlet of the siphon tube 21 of the toilet 20, when the water accommodated in the body part 100 is pressed by the pressurizing part 200 while the siphon insertion port 140 is inserted into the inlet of the siphon tube 21 of the toilet 20, the water accommodated in the body part 100 is discharged with an instantaneous pressure toward the siphon tube 21 of the toilet 20, delivering powerful pressure and water to foreign matter 23 clogging the siphon tube 21.

At this time, as the toilet 20 has a shape in which the bowl gradually narrows toward the starting point of the siphon tube 21, correspondingly, the siphon insertion port 140 may be formed in a shape in which an area becomes narrower toward one end.

Figure 5:
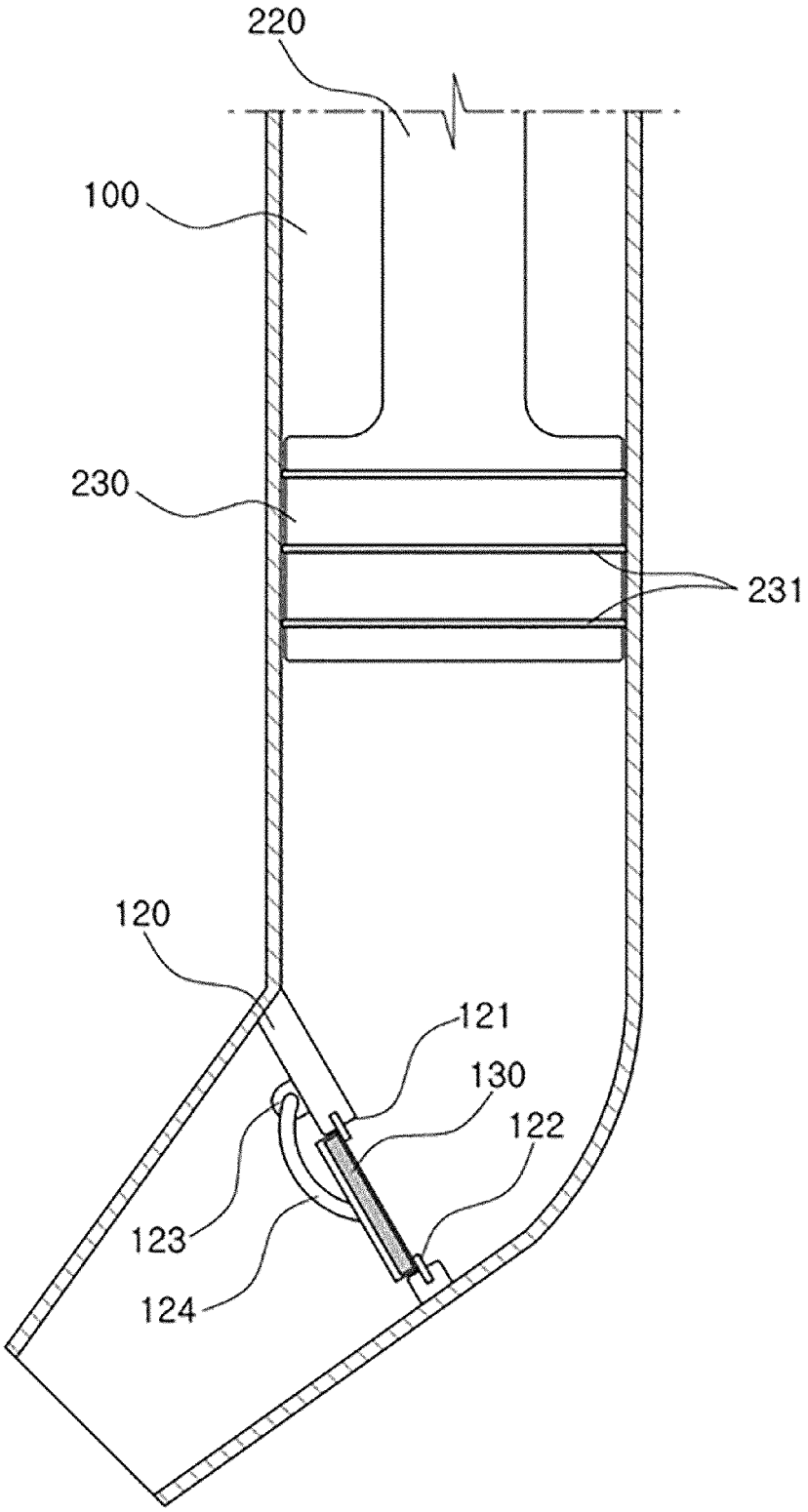
FIG. 5 is an exemplary view of one end of the body part according to the embodiment of the present disclosure.

In addition, as shown in FIGS. 3 and 5, the body part 100 may be provided with the discharge port 120 at one end thereof formed in a plate shape having an edge corresponding to the inner side of the body part 100.

The discharge port 120 may be opened or closed by the coupling of a discharge hole 121 formed therein and the opening/closing port 130. When the discharge port 120 is closed, water injected into the body part 100 may be accommodated in the body part 100, whereas when the discharge port 120 is opened, water accommodated in the body part 100 may be discharged in one direction of the body part 100.

As shown in FIG. 5, the discharge port 120 may be disposed in an area adjacent to the siphon insertion port 140 formed in the body part 100. A hinge 123 is formed on one side of the discharge port 120 in the direction in which the water accommodated inside the body part 100 is discharged. As one end of a connecting port 124 is coupled to the hinge 123 and the other end of the connecting port 124 is coupled to one surface of the opening/closing port 130, the opening/closing port 130 rotates at a certain position.

At this time, the discharge hole 121 may be provided with a flange 122 having magnetic properties on the inner periphery thereof, and the opening/closing port 130 may be formed of a material having magnetic properties. Accordingly, as the opening/closing port 130 is coupled with the flange 122 provided on the inner periphery of the discharge hole 121 by magnetic force, the discharge hole 121 may be closed or opened. For example, when pressure is delivered from the pressurizing part 200, the discharge hole 120 is opened as the coupling between the opening/closing port 130 and the discharge hole 121 by magnetic force is released by the pressure.

At this time, as the water accommodated in the body part 100 is sprayed by pressure, the water may be discharged to one end of the siphon insertion port 140 with an instantaneous pressure.

Figure 13:
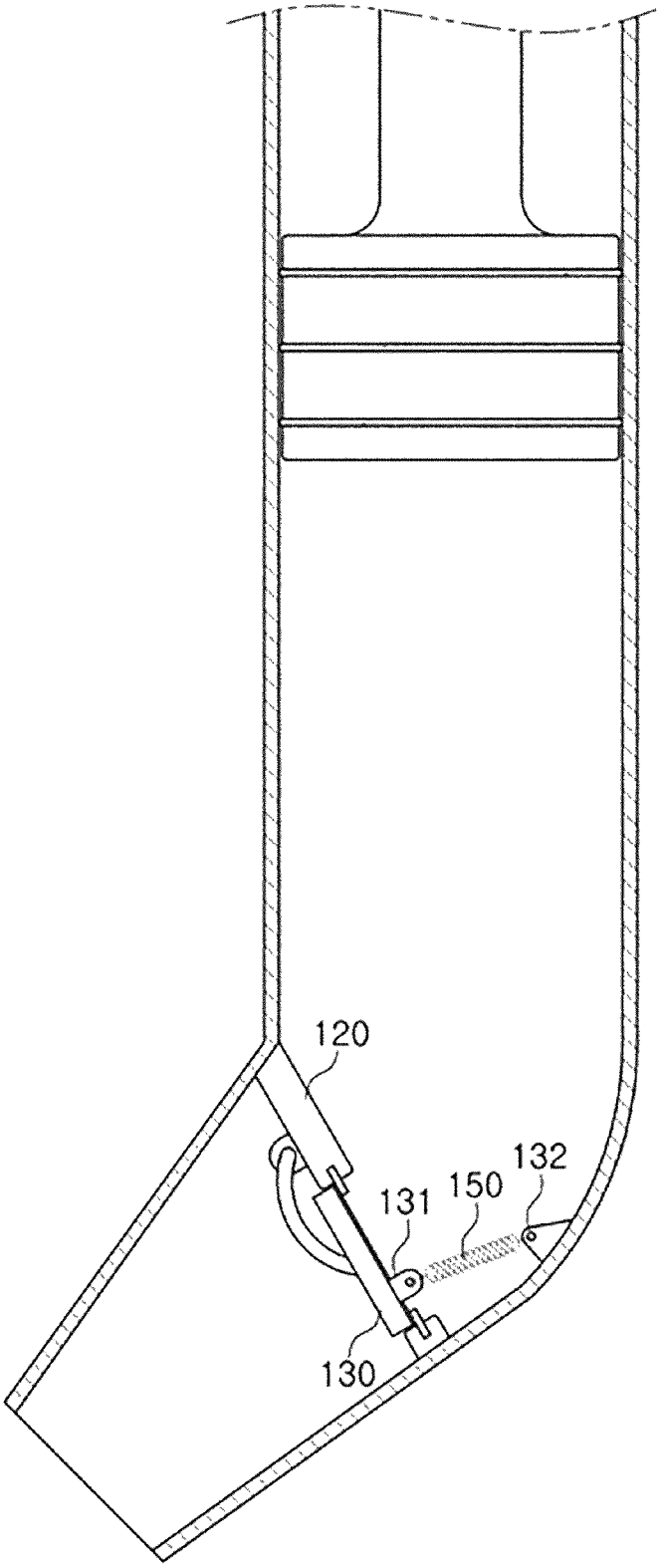
FIGS. 13 to 14 are exemplary views of a discharge port opened and closed by an elastic member according to the embodiment of the present disclosure.
Figure 14:
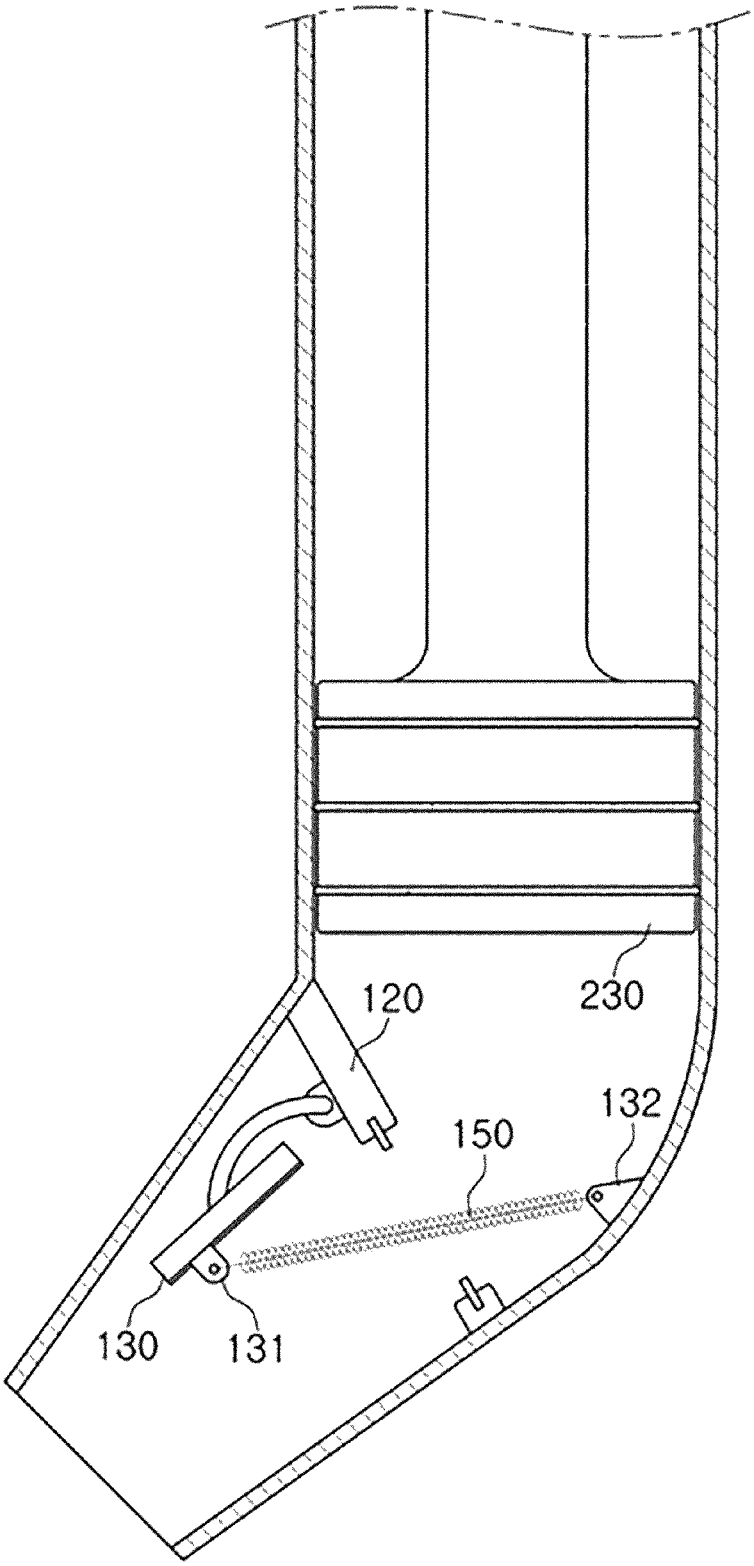

As another example, as shown in FIGS. 13 to 14, the discharge hole 120 may be opened and closed as the opening/closing port 130 and a point inside the body part 100 are coupled by an elastic member 150. For example, the opening/closing port 130 may be provided with a first spring piece 131 on one side in the piston direction of the opening/closing port 130, and a second spring piece 132 may be formed at a point inside the body part 100 facing the first spring piece 131, so that the first spring piece 131 and the second spring piece 132 may be connected by the elastic member 150.

Due to this, the discharge hole 120 maintains a closed state by the elastic member 150 at normal times, and when a user presses the pressurizing part 200 in the direction of the discharge port 120 while water is accommodated in the body part 100, the water accommodated inside the body part 100 is sprayed by pressure, and the opening/closing port 130 is pressed by the water and instantaneous pressure and the discharge hole 120 is opened, so that the water may be discharged to one end of the siphon insertion port 140.

As shown in FIGS. 1 to 4, the pressurizing part 200 may be provided with a handle 210 at the other end thereof, and one end thereof may include the piston 230 disposed inside the body part 100. At this time, at least one piston O-ring 231 for sealing the inside of the body part 100 may be provided on the outer periphery of the piston 230.

In addition, the pressurizing part 200 may be provided with a stopper 260 at one end thereof, in an area adjacent to the handle 210. Because of the stopper 260, in pressing the pressurizing part 200 toward the body part 100, it is possible to inhibit the pressurizing part 200 from being inserted into the body part 100 beyond a certain length.

As another example, as shown in FIGS. 7 to 12, the pressurizing part 200 may further include piston valves 240A and 240B on the piston 230 provided at one end thereof.

Figure 7:
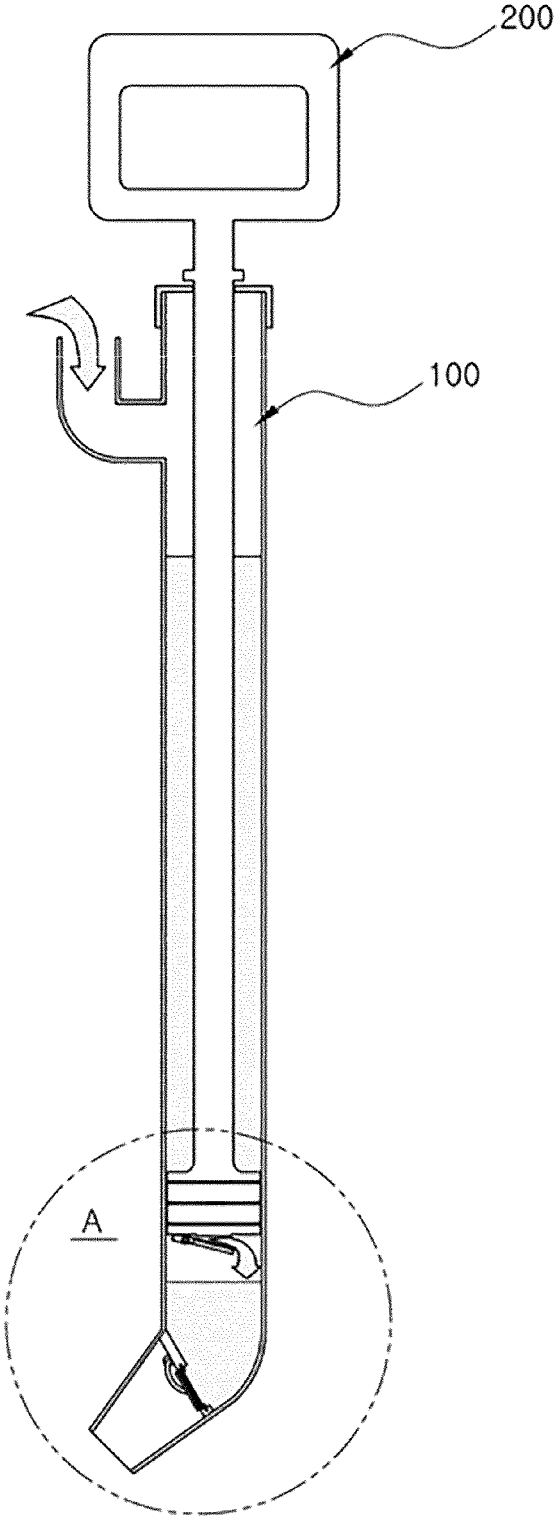
FIGS. 7 to 12 are exemplary views of the water jet plunger to which a piston valve according to the embodiment of the present disclosure is applied.
Figure 8:
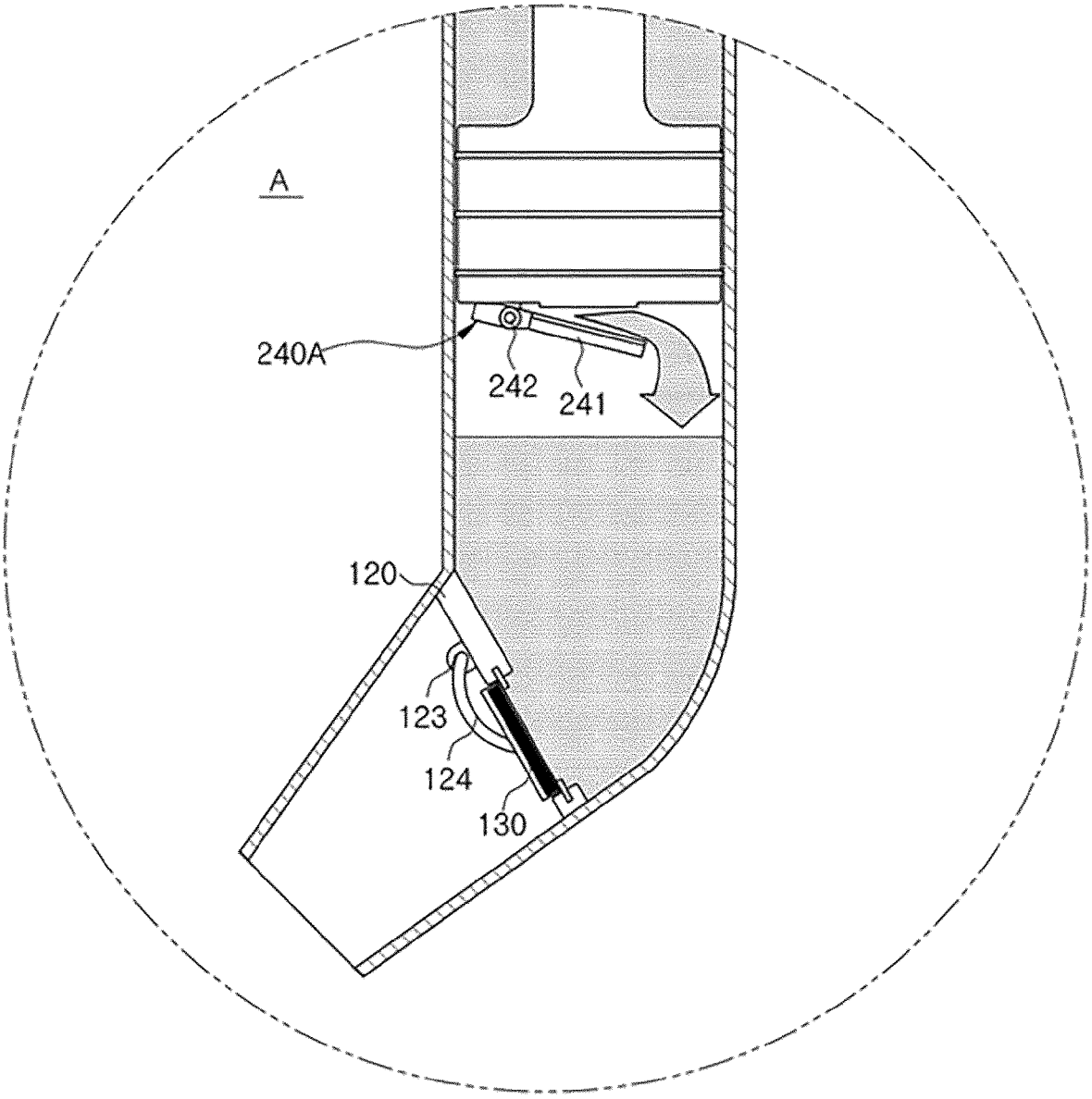
Figure 9:
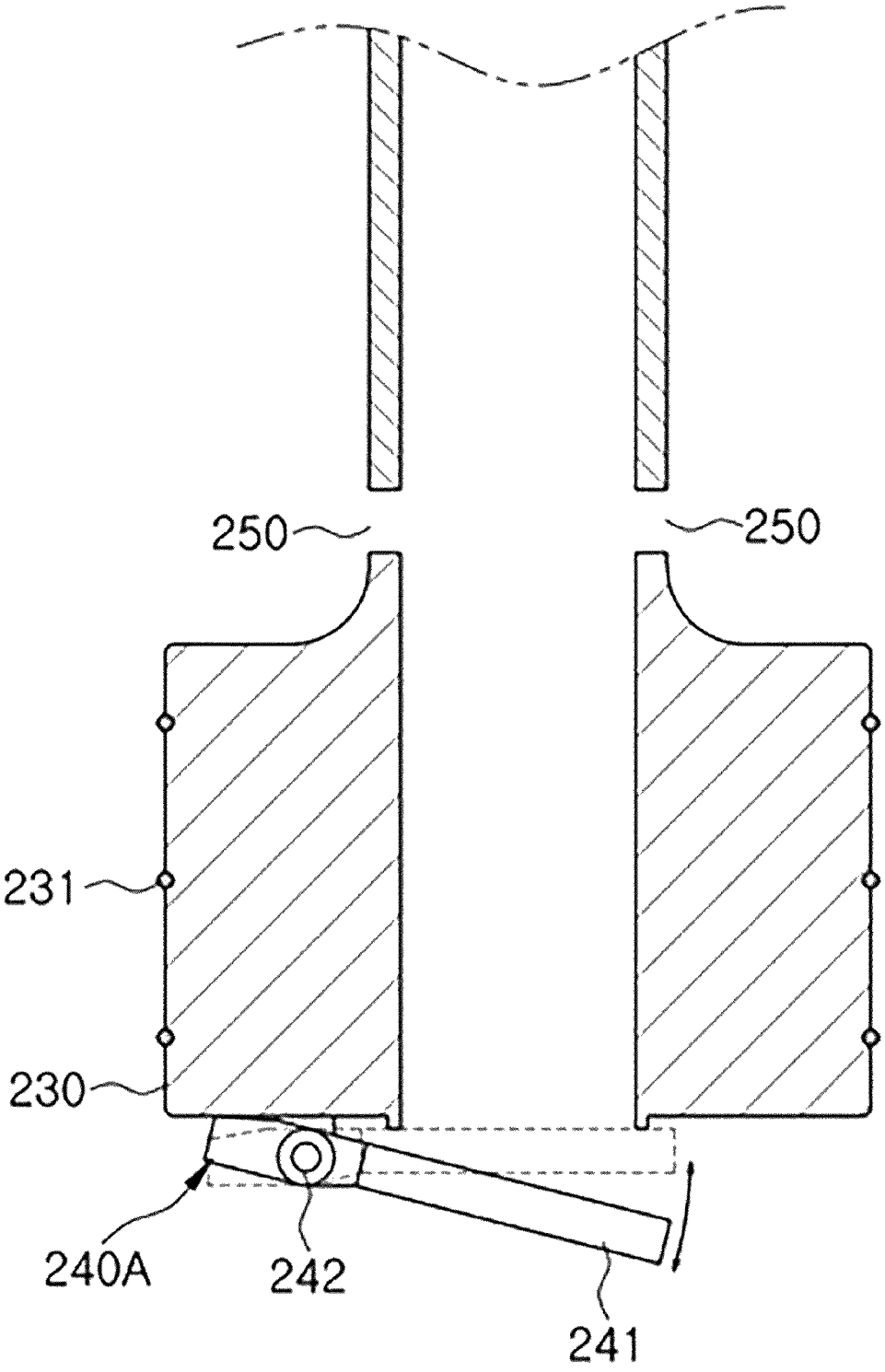

At this time, as shown in FIGS. 7 to 9, the piston 230 may have a hole communicating with one surface in the direction of the discharge port 120 and the pressurizing part 200. The hole communicating with the pressurizing part 200 is formed to be opened and closed by the piston valve 240A composed of a piston valve hinge 242 and a piston valve opening/closing plate 241.

The hole may be normally kept open, but when the piston 230 moves in the direction of the discharge port 120 of the body part 100 when the pressurizing part 200 receives force from the outside, the hole communicating with the pressurizing part 200 may be closed.

At this time, in the pressurizing part 200, a water inflow inlet 250 may be formed at a point adjacent to the upward direction of the piston 230 to allow water accommodated in the body part 100 to flow into the pressurizing part 200.

Thus, when water is accommodated inside the body part 100 and above the piston 230, the water moved into the pressurizing part 200 through the water inflow inlet 250 may pass through the internal space of the piston 230 and may be moved in the direction of the discharge port 120 of the body part 100 as the piston valve 240A is opened.

As such, in introducing water into the body part 100, water may flow into the body part 100 regardless of the position of the piston 230 of the pressurizing part 200.

Figure 10:
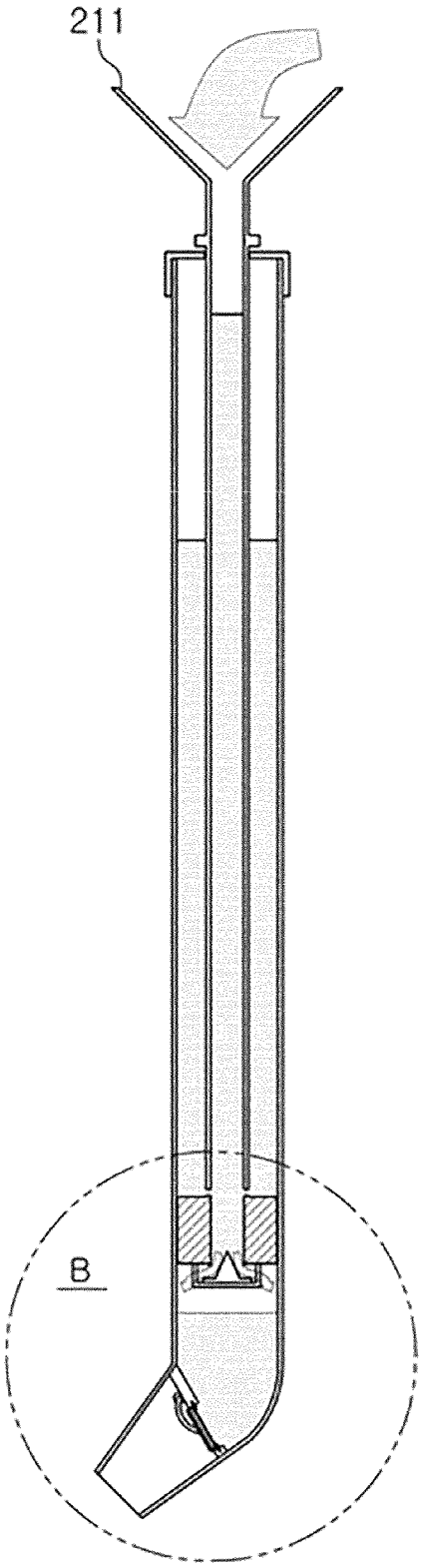
Figure 11:
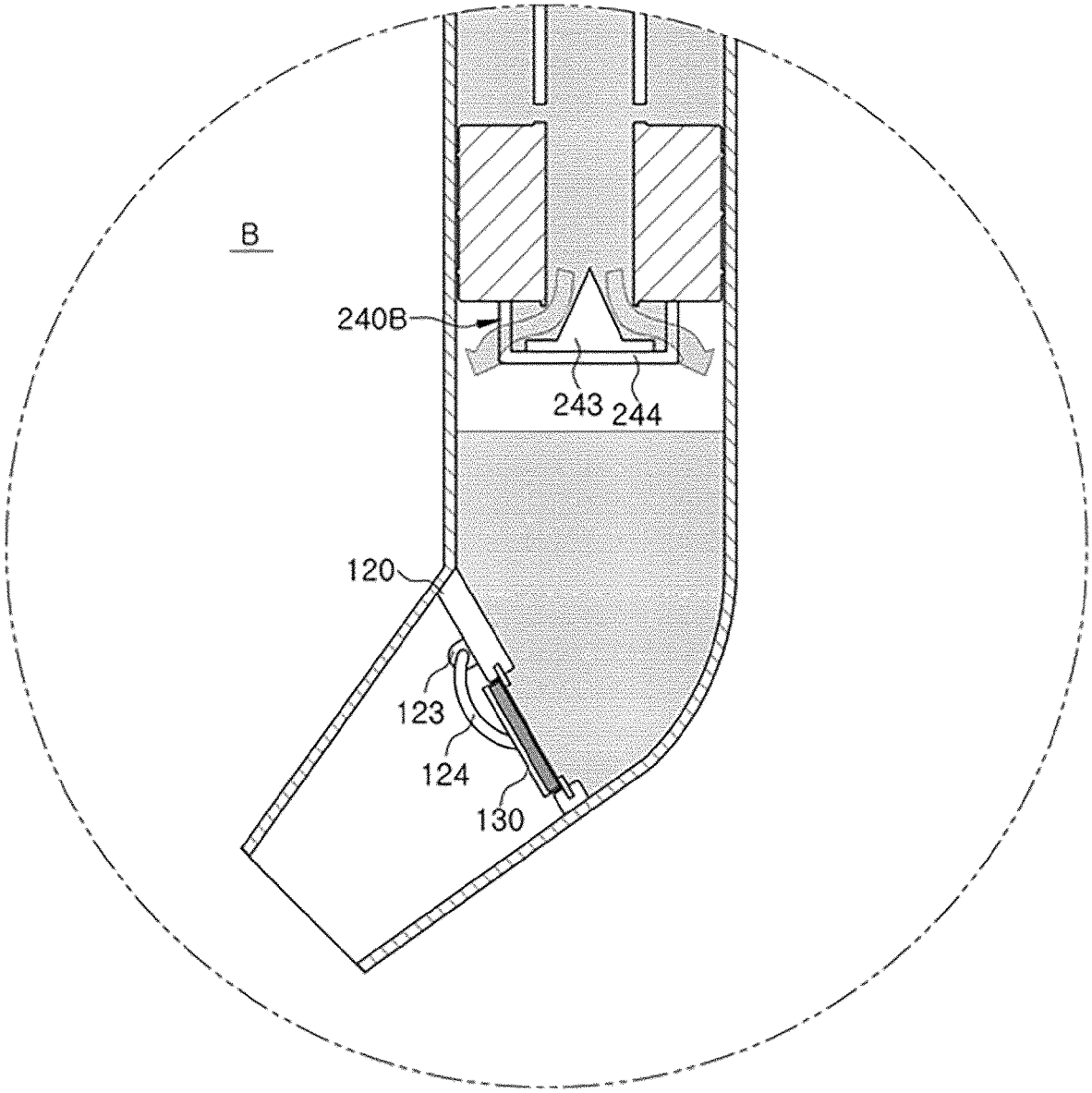
Figure 12:
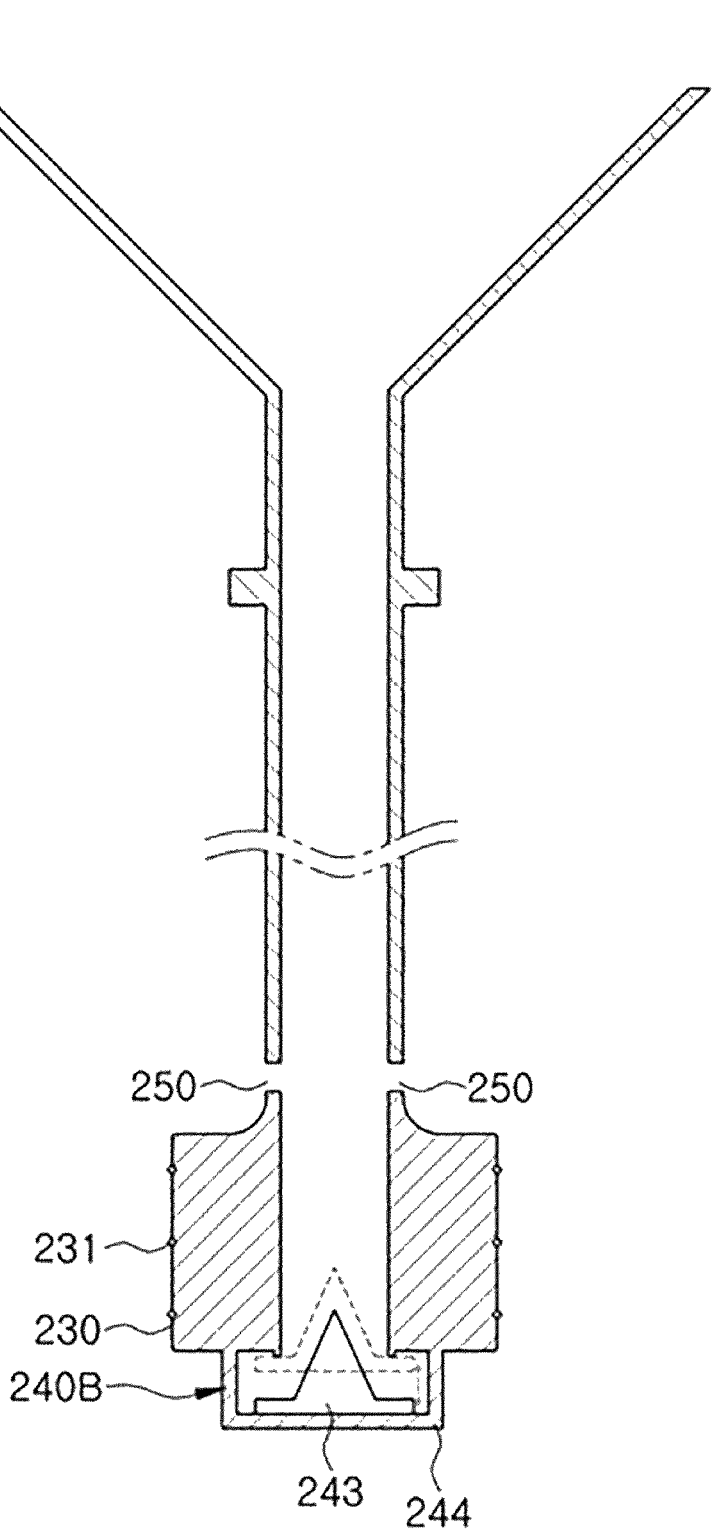
Figure 15:
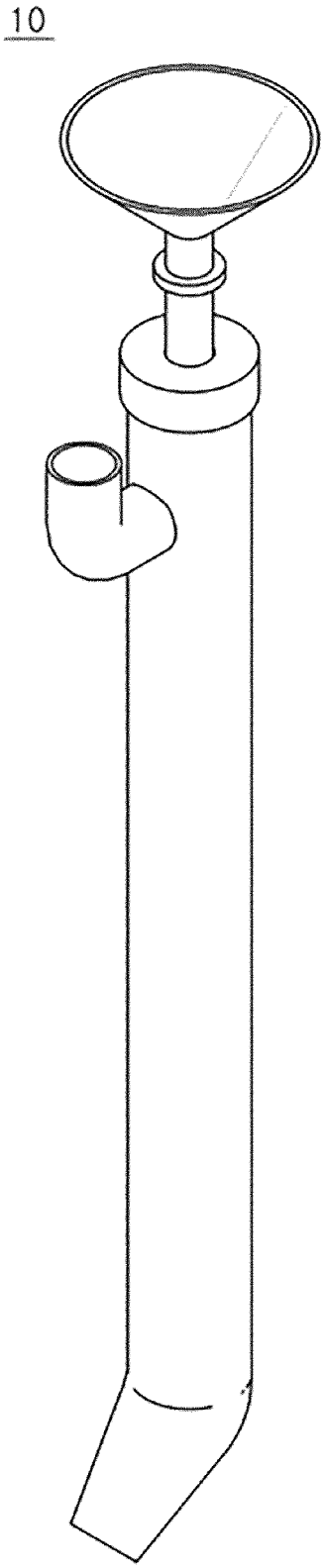
FIG. 15 is an exemplary view of the water jet plunger provided with a water injection inlet in the pressurizing part according to the embodiment of the present disclosure.

In addition, as another example, as shown in FIGS. 10, 11, and 15, the pressurizing part 200 may be formed in a tubular shape with an empty inside, and may be provided with a water injection inlet 211 at the other end thereof. At this time, the piston 230 may have a hole formed on one surface in the direction of the discharge port 120 and that communicates with the pressurizing part 200. The hole may be provided with the piston valve 240B composed of a piston valve cap 243 and a cap support 244.

Due to this, when a user injects water through the water injection inlet 211 formed at the other end of the pressurizing part 200, the water may move toward the discharge port 120 of the body part 100 through the inside of the pressurizing part 200 and through the piston valve 240B without passing through the body part 100.

At this time, in the piston valve 240B, the piston cap 243 is positioned on the cap support 244 located therebelow due to gravity, so that the water injected through the water injection inlet 211 may move toward the discharge port 120.

At this time, when the user presses the pressurizing part 200 to discharge water, the piston valve cap 243 comes into contact with the water, and accordingly, the hole formed in the piston is closed by pressure. Therefore, in using the water jet plunger 10, water does not flow backward in the direction of the pressurizing part 200.

SEQUENCE LISTING FREE TEXT

Description of Reference Numerals

10: waterjet plunger
20: toilet 21: siphon tube
22: water 23: foreign matter
100: body part 110: water injection inlet
120: discharge port 121: discharge hole
122: flange 123: hinge
124: connecting port 130: opening/closing port
131: first spring piece 132: second spring piece
140: siphon insertion port 150: elastic member
200: pressurizing part 210: handle
211: water injection inlet
220: rod 230: piston
231: piston o-ring 240A: elastic piston valve
240B: pressure piston valve 241: piston valve opening/closing plate
242: piston valve hinge 243: piston valve cap
244: cap support
250: water inflow inlet 260: stopper

The invention claimed is:

1. A waterjet plunger, comprising:

a body part (100) configured to have a tubular shape; and a pressurizing part (200) disposed inside the body part (100), and configured to have a piston (230) capable of reciprocating in a longitudinal direction of the body part (100) at a first end thereof, wherein the body part (100) comprises:

a discharge port (120) configured to control water injected from an outside on a first end side thereof, wherein the discharge port (120) is opened by pressure generated as water accommodated in the body part (100) is pressed by the pressurizing part (200) to discharge the water toward the first end of the body part (100), wherein the discharge port (120) is coupled with an opening/closing port (130) provided on a first end side of an inner side of the body part (100) by magnetic force to inhibit water from being discharged to the outside, and the discharge port (120) is opened as the opening/closing port (130) is pressed toward the discharge port (120) by the pressure generated from the pressurizing part (200).

2. The waterjet plunger of claim 1, wherein the body part (100) further comprises:

a siphon insertion port (140) provided at the first end thereof at an obtuse angle with the body part (100), and configured to have a size corresponding to an inlet of a siphon tube (21) of a toilet (20) so as to be insertable into the siphon tube (21) of the toilet (20).

3. The waterjet plunger of claim 1, wherein the discharge port (120) is provided with a discharge hole (121) therein and formed in a plate shape with an edge corresponding to the inner side of the body part (100), wherein the discharge hole (121) is provided with a ring-shaped flange (122) having magnetic properties on an inner periphery thereof so as to be coupled with the opening/closing port (130) by a magnetic force, and a connecting port (124) coupled to a hinge (123), provided on a surface of the discharge port (120) in a direction in which water is discharged, is connected to a surface of the opening/closing port (130) so that the discharge hole (121) and the opening/closing port (130) are coupled by the magnetic force at a certain position.

4. The waterjet plunger of claim 1, wherein the discharge port (120) is opened and closed as the opening/closing port (130) and a point inside the body part (100) are coupled by means of an elastic member (150).

5. The waterjet plunger of claim 1, wherein the body part (100) further comprises:

a water injection inlet (110) formed to be inclined upward at a second end thereof for injecting water into the body part (100) from the outside.

6. The waterjet plunger of claim 1, wherein the pressurizing part (200) has a hollow shape, and the piston (230) comprises;

a longitudinal hole at a position corresponding to an inner space of the pressurizing part (200), and piston valves (240A, 240B) provided on a surface in a direction of the discharge port (120), and configured to be opened and closed so that water introduced into the pressurizing part (200) from the outside moves in the direction of the discharge port (120).

7. The waterjet plunger of claim 6, wherein the pressurizing part (200) is provided with a water inflow inlet (250) in an upper direction adjacent to the piston (230), wherein the water inflow inlet (250) allows water introduced into the body part (100) and accommodated above the piston (230) to flow into the inner space of the pressurizing part (200).

8. The waterjet plunger of claim 6, wherein the pressurizing part (200) further comprises:

a water injection inlet (211) provided at a second end thereof to allow water to flow into an inside of the pressurizing part (200).

* * * * *